US006276320B1

(12) United States Patent
Fujii et al.

(10) Patent No.: US 6,276,320 B1
(45) Date of Patent: Aug. 21, 2001

(54) VALUE MECHANISM OF INTERNAL COMBUSTION ENGINE

(75) Inventors: Noriaki Fujii; Kouta Yoshiura, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/432,763

(22) Filed: Nov. 3, 1999

(30) Foreign Application Priority Data

Nov. 5, 1998 (JP) ..... 10-314281

(51) Int. Cl.[7] ..... F01L 13/00

(52) U.S. Cl. ..... 123/90.16; 123/90.42; 123/90.44; 123/90.6

(58) Field of Search ..... 123/90.15, 90.16, 123/90.17, 90.22, 90.27, 90.39, 90.42, 90.44, 90.6, 198 F, 308

(56) References Cited

U.S. PATENT DOCUMENTS

| | | | | |
|---|---|---|---|---|
| Re. 34,553 | * | 3/1994 | Konno | 123/90.4 |
| 5,456,225 | * | 10/1995 | Oikawa et al. | 123/90.16 |
| 5,495,832 | * | 3/1996 | Fujii | 123/90.16 |
| 5,529,032 | * | 6/1996 | Oikawa et al. | 123/90.16 |
| 5,592,907 | * | 1/1997 | Hasebe et al. | 123/90.16 |

FOREIGN PATENT DOCUMENTS 8-61031 3/1996 (JP) .

* cited by examiner

*Primary Examiner*—Weilun Lo
(74) *Attorney, Agent, or Firm*—Armstrong, Westerman, Hattori, McLeland & Naughton, LLP

(57) ABSTRACT

In a valve mechanism of an internal combustion engine having a cylinder with a pair of air-intake valves, the number of operation modes of the air-intake valves in accordance with engine operation region is increased to improve combustion nature in a combustion chamber and engine output and to miniaturize the valve mechanism. The valve mechanism comprises first and second drive rocker arms operatively connected with the respective air-intake valves, first, second and third free rocker arms coming into contact with first, second and third operation cams having profiles for making the air-intake valve perform opening-closing motion. The drive rocker arms are connected and disconnected with the free rocker arms in accordance with engine operation states, thereby a state in which both the air-intake valves are closed for pause, a state in which one of the air-intake valves performs opening-closing motion with a small lift and another air-intake valve is closed for pause, a state in which both the air-intake valves perform opening-closing motion with a small lift, or a state in which both the air-intake valves perform opening-closing motion with a large lift is obtained. Pipe members with fan-shaped cross-section are inserted in a rocker arm shaft to form oil-pressure supply passages for switching over the connection states.

12 Claims, 9 Drawing Sheets

VALUE MECHANISM OF INTERNAL COMBUSTION ENGINE

BACKGROUND OF THE INVENTION

The present invention relates to a valve mechanism of a multi-cylinder internal combustion engine, particularly such a valve mechanism in which a pair of air-intake valves provided on a cylinder can be closed together to make the cylinder pause and lift, of each air-intake valve can be changed independently in accordance with engine operation regions.

Hitherto, a valve mechanism of a multi-cylinder internal combustion engine in which a pair of air-intake valves provided on a cylinder can be closed together to make the cylinder pause and lift of each air-intake valve can be changed independently in accordance with engine operation regions is known (see Japanese Laid-Open Patent Publication No. 8-61031.

The above-mentioned valve mechanism comprises first and second drive rocker arms which are operatively connected to the respective air-intake valves and contacted with circular pause sections of a cam shaft, a first free rocker arm contacted with a substantial pause cam enabling the air-intake valve to open slightly, a second free rocking arm contacted with a low-speed cam for making the air-intake valve open with a small lift, and a third free rocker arm contacted with a high-speed cam for making the air-intake valve open with a large lift.

The first and second drive rocker arms and the first, second and third free rocker arms are connected or disconnected with each other suitably by switchover means so that the operation mode of the air-intake valves can be switched over. Namely, both the air-intake valves are closed by the pause sections in an engine pause state, one of the air-intake valves is made to perform opening-closing motion by the low-speed cam while another air-intake valve is made to substantially pause by the substantial pause cam in an engine low-speed operation region to produce swirl within a combustion chamber for improvement of combustion, and both the air-intake valves are made to perform opening-closing motion by the high-speed cam in an engine high-speed operation region to improve engine output.

In a rocker arm shaft of the valve mechanism are formed two switching oil-pressure supply passages of circular cross sections for supplying oil-pressure to the connection switchover means.

In the above valve mechanism, the operation mode of the air-intake valves is shifted from a state that one air-intake valve is made to perform opening-closing motion by the low-speed cam as well as another air-intake valve is made to substantially pause by the substantial pause cam in an engine low-speed operation region, to a state that both the air-intake valves are made to perform opening-closing motion by the high-speed cam in an engine high-speed operation. Accordingly, in a part of the engine low-speed operation region near the high-speed region where only one air-intake valve opens with the small lift, sufficient engine output cannot be obtained.

Since a plurality of the switching oil-pressure supply passages, which are usually formed by mechanical work and of relatively small diameter, must be provided within the rocker arm shaft, the working takes much time. Further, since each of the two switching oil-pressure supply passages formed in the rocker arm shaft has a circular cross section, the inner space of the rocker arm shaft is not necessarily utilized efficiently. Therefore, in order to ensure a necessary passage area of the switching oil-pressure supply passage, sometimes the diameter of the rocker arm shaft must be enlarged and it obstructs miniaturization of the valve mechanism.

The present invention has been accomplished in order to overcome the above difficulties, and a subject of the invention is to improve the nature of combustion in the combustion chamber and output of the engine, by increasing the number of operation modes of the air-intake valves depending on engine operation regions, in a valve mechanism of a multi-cylinder internal combustion engine having a cylinder provided with a pair of air-intake valves. Another subject of the invention is cost reduction and miniaturization of the valve mechanism.

SUMMARY OF THE INVENTION

The present invention provides a valve mechanism of an internal combustion engine having a cylinder with a pair of air-intake valves, comprising: a cam shaft having a pair of pause sections for holding the air-intake valves substantially in closing pause states, a first operation cam with a profile capable of causing the air-intake to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams; a first drive rocker arm operatively connected to one of the air-intake valves and contacted with one of the pause sections of the cam shaft; a second drive rocker arm operatively connected to another air-intake valve and contacted with another pause section of the cam shaft; a first free rocker arm contacted with the first operation cam; a second free rocker arm contacted with the second operation cam; a third free rocker arm contacted with the third operation cam; a first connection switchover means for connecting and disconnecting the first drive rocker arm with the first free rocker arm; a second connection switchover means for connecting and disconnecting the second drive rocker arm with the second free rocker arm; and a third connection switchover means for connecting and disconnecting the first drive rocker arm and the second drive rocker arm with the third free rocker arm.

According to the invention, the air-intake valves provided on one cylinder can take a first state in which both the air-intake valves are substantially closed to pause, a second state in which one air-intake valve is made to perform opening-closing motion substantially by the first or second operation cam as well as another air-intake valve is substantially closed to pause, a third state in which one air-intake valve is made to perform opening-closing motion substantially by the first operation cam as well as another air-intake valve is made to perform opening-closing motion substantially by the second operation cam, and a fourth state in which both the air-intake valves are made to perform opening-closing motion substantially by the third operation cam. Therefore, desirable operation modes of the air-intake valves can be set according to engine operation regions, in view of cylinder pause, swirl generation in the combustion chamber to improve combustion nature or improvement of engine output.

More concretely, in the first state, the engine can be operated with the cylinder pausing. In the second state, only one air-intake valve is made to perform opening-closing motion to cause a vortex or a swirl in the combustion chamber so that combustion nature is improved and circulation of a large amount of exhaust gas and lean mixture combustion become possible. In the third state, since both the air-intake valves are made to perform opening-closing motion with a lift smaller than that in the fourth state, engine output can be improved compared to prior art in a transition region between an engine operation region by the second state and an engine operation region by the fourth state. Further, since profiles of the first and second operation cams can be made identical or different, formation of the swirl in the combustion chamber and amount of intake air into the combustion chamber can be set with increased freedom. In the fourth state, since both the air-intake valves are made to perform opening-closing motion with the largest lift, a high engine output can be obtained.

The above valve mechanism may be provided with a control means by which in an engine operation region with the cylinder pausing, the first, second and third connection switchover means are in disconnecting states; in an engine operation region with a small amount of intake air, the first connection switchover means is in a connecting state and the second and third connection switchover means are in disconnecting state; in an engine operation region with a middle amount of intake air, the first and second connection switchover means are in connecting states and the third connection switchover means is in a disconnecting state; and in an engine operation region with a large amount of intake air, the third connection switchover means is in a connecting state.

According the valve mechanism, both the air-intake valves can be closed for enabling the engine to operate with the cylinder pausing. In the engine operation region with a small amount of intake air, one air-intake valve is opened with a lift smaller than that of the third operation cam and another air-intake valve is closed to pause, therefore vortex or swirl can be produced in the combustion chamber to improve combustion nature, and circulation of a large amount of exhaust gas or lean mixture combustion in an engine low-speed or low-load operation region become possible to improve emission or fuel consumption. Further, in the engine operation region with a middle amount of intake air, both the air-intake valves are opened with a lift smaller than that of the third operation cam so that engine output can be improved in a transition engine operation region between an engine low-speed or low-load operation region and an engine high-speed or high-load operation region. In the engine operation region with a large amount of intake air, both air-intake valves are opened with large lift so that a high engine output necessary in this operation region can be obtained.

The above-mentioned valve mechanism may be provided with pipe members of fan-shaped cross section provided in an axial hole of a rocker arm shaft pivotally supporting the rocker arms. The pipe members communicate with the first, second and third connection switchover means to constitute first, second and third switching oil-pressure supply passages respectively.

According to such a valve mechanism, since the switching oil-pressure supply passages are formed easily only by inserting three pipe members into an axial hole of the rocker arm shaft, for example into a hollow portion of a pipe-shaped rocker arm shaft, cost can be reduced. Moreover, since each of the pipe members has a fan-shaped cross section, the entire shape of the three pipe members inserted into the axial hole of the rocker arm shaft can be made cylindrical, therefore, the space of the axial hole can be utilized effectively. Three switching oil-pressure supply passages having necessary passage areas can be arranged within the shaft compactly so that the valve mechanism can be miniaturized.

In the aforementioned valve mechanism, the air-intake valves may be operatively connected to the first and second drive rocker arms through hydraulic tappets respectively, a hydraulic tappet holder for holding the hydraulic tappets may have respective hydraulic tappet holding sections, and a recess maybe formed between the hydraulic tappet holding sections for receiving a roller of the third free rocker arm contacted with the third operation cam.

According to the valve mechanism, the roller of the third free rocker arm can be received in the recess between the hydraulic tappet holding sections when the third free rocker arm closely approaches the hydraulic tappet holder, therefore both horizontal and vertical distances between the hydraulic tappet holding section and the rocker arm shaft can be set short; that is, the hydraulic tappet holding section can be disposed at a place near the rocker arm shaft to miniaturize the valve mechanism. And freedom of layout of valve mechanism component members in a limited valve mechanism chamber is increased.

In this specification, the substantial closed pause state of the air-intake valve means a state that the air-intake valve is made not to perform opening-closing motion at all, or a state that the air-intake valve is made to perform opening-closing motion with a slight lift, but air flowing into the combustion chamber when the air-intake valve opens is so little that combustion in the combustion chamber is not affected by the air. The expression that the air-intake valve performs opening-closing motion substantially means that the air-intake valve performs opening-closing motion with a lift such that air flowing into the combustion chamber when the air-intake valve opens participates in the combustion.

DETAILED DESCRIPTION OF PREFERRED EMBODIMENT OF THE INVENTION

Hereinafter, a preferred embodiment of the present invention will be described with reference to FIGS. 1 to 9.

Figure 1:
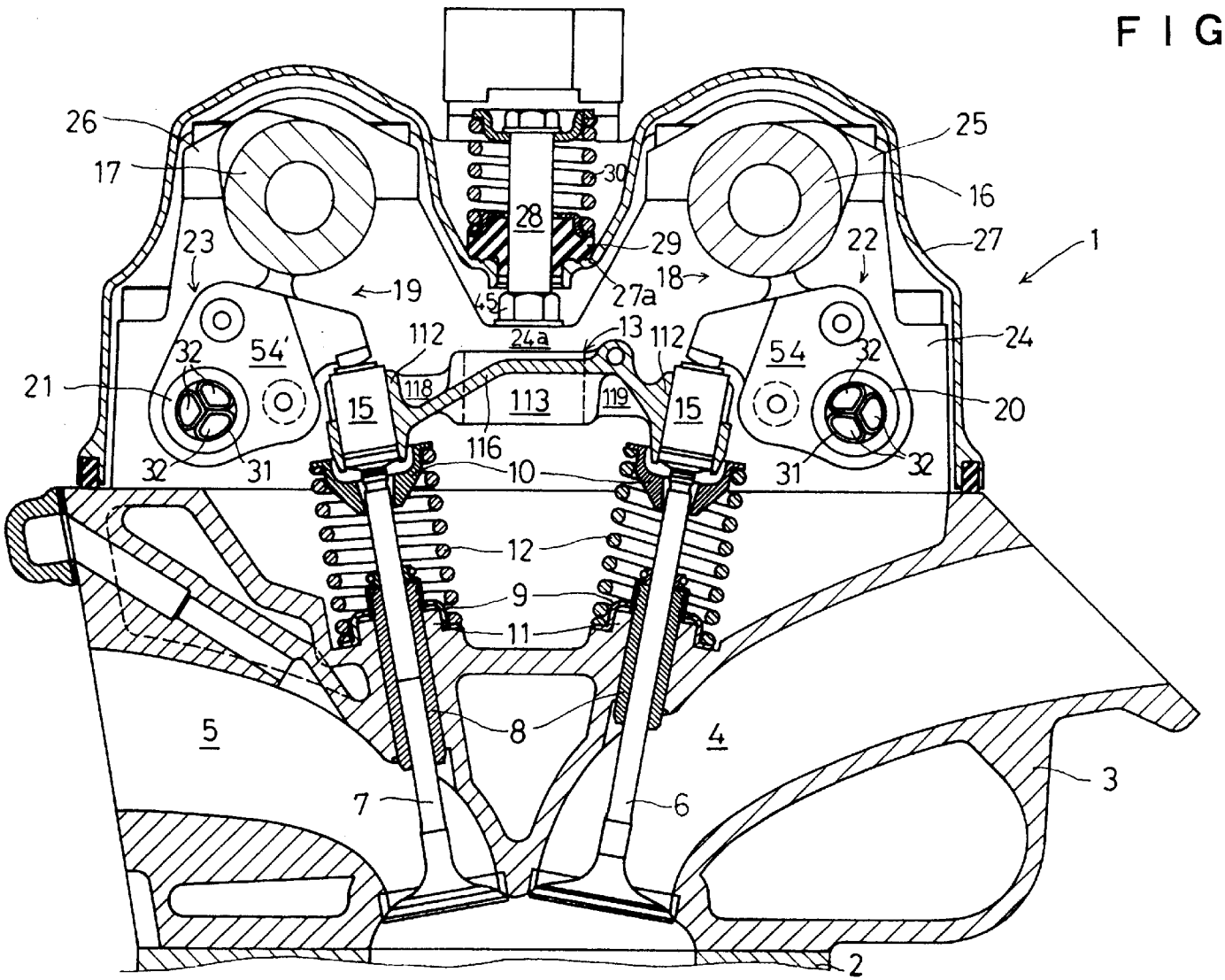
FIG. 1 is a sectional view of a valve mechanism of a multi-cylinder internal combustion engine according to a preferred embodiment of the present invention.
Figure 4:
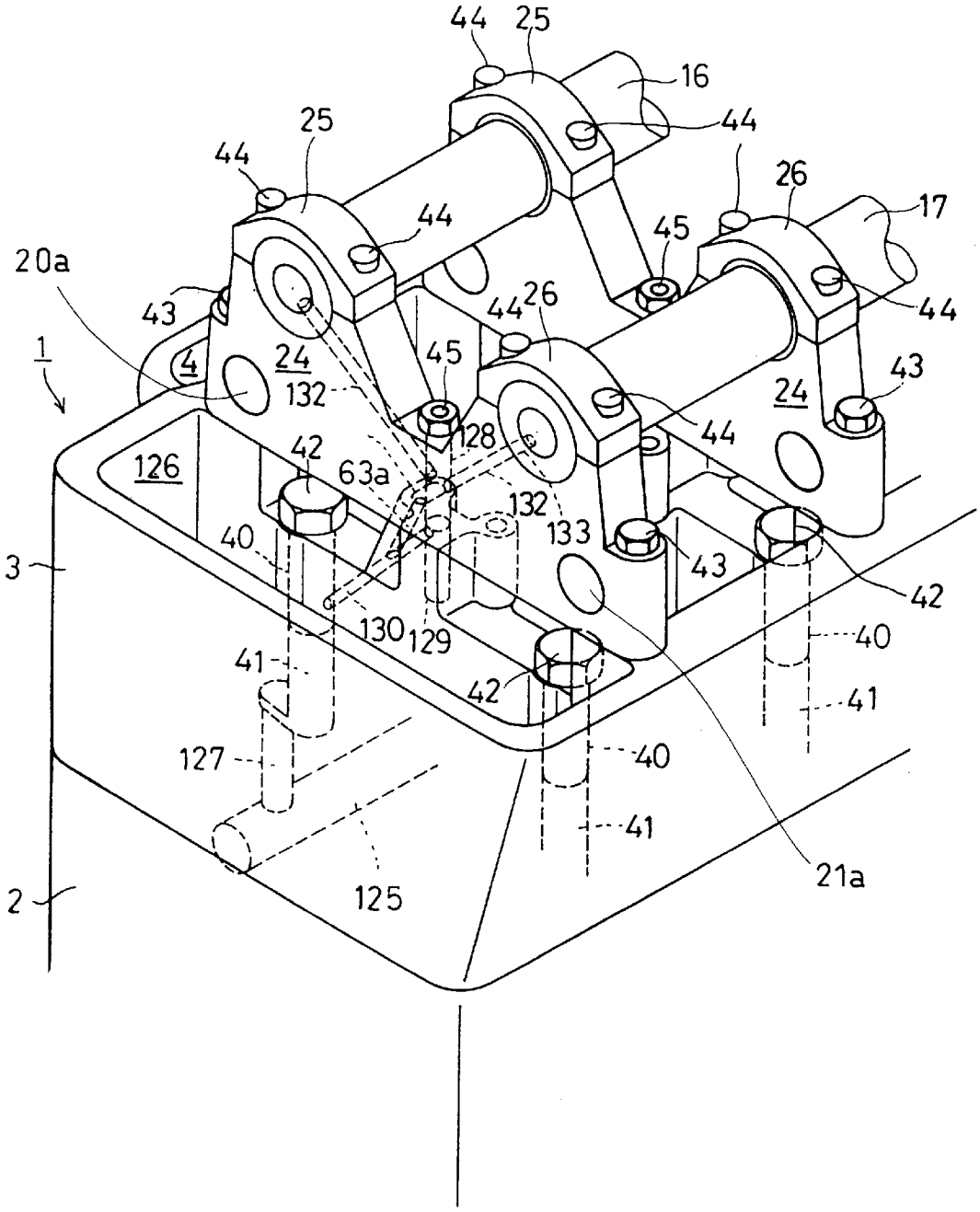
FIG. 4 is a perspective view showing arrangement of rocker arm shaft holders and oil passages.

The internal combustion engine 1 shown in FIG. 1 is a four stroke cycle V-type eight cylinder (four cylinders in one side) overhead valve internal combustion engine. In each cylinder of a cylinder block 2 is fitted a piston (not shown)

so as to slide, and on an upper surface of the cylinder block 2 is connected a cylinder head 3 forming a combustion chamber together with the piston. Namely, as shown in FIG. 4, the cylinder head 3 is formed with bolt holes 40 arranged surrounding the combustion chamber. The cylinder block 2 is also formed with bolt holes 41 along downward extension lines of the bolt holes 40 and bolts 42 passing through the bolt holes 40 are screwed into the bolt holes 41 to combine the cylinder head 3 with the cylinder block 2.

At every cylinder of the cylinder head 3 is provided a pair of air-intake valve openings and a pair of exhaust valve openings which open toward the combustion chamber. As shown in FIG. 1, the air-intake valve openings communicate with an intake port 4 opening on a side surface (inside of V-bank) of the cylinder head 3, and the exhaust valve openings communicate with an exhaust port 5 opening on another side surface (outside of V-bank) of the cylinder head. At the air-intake valve openings are provided respective air-intake valves 6 so as to perform opening-closing motion separately, and at the exhaust valve openings are provided respective exhaust valves 7 so as to perform opening-closing motion separately. Further, on one side surface of the cylinder head 3 is connected an intake manifold communicating with the intake port 4, and on another side surface is connected an exhaust manifold communicating with the exhaust port 5.

At each upper end of valve guides 8 of the air-intake valves 6 and the exhaust valves 7 is provided a valve spindle seal 9, and a valve spring retainer 10 is attached to an end of the valve spindle. A valve spring 12 is inserted between the valve spring retainer 10 and a valve spring retaining section 11 of the cylinder head 3. The air-intake valve 6 and the exhaust valve 7 are energized by spring force of the valve spring 12 so as to always close the air-intake valve opening and the exhaust valve opening, respectively.

Figure 3:
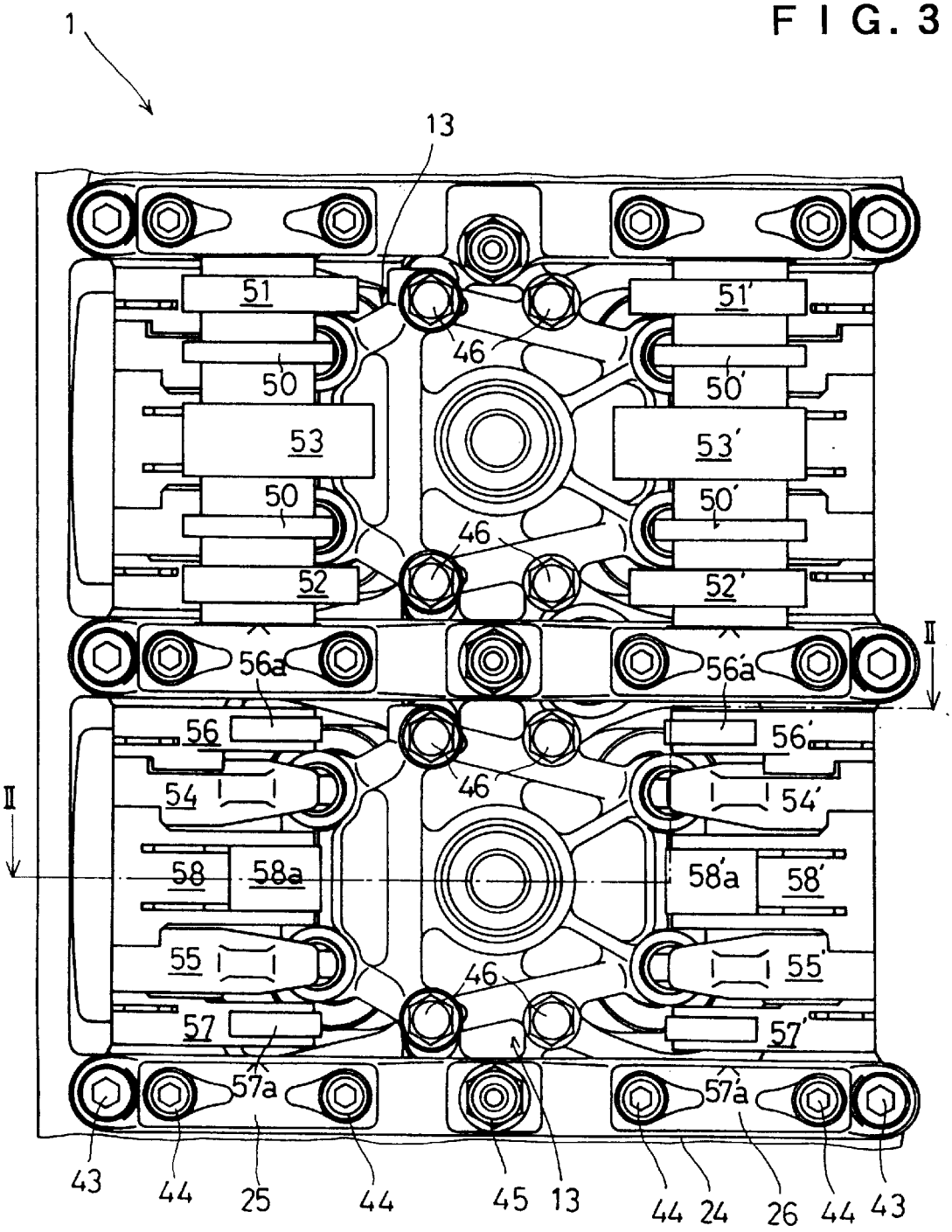
FIG. 3 is a plan view of the valve mechanism of FIG. 1 with a cylinder head cover removed and some parts of rocker arms and rocker arm shafts omitted.

For each cylinder, an hydraulic tappet holder 13 is attached to the cylinder head 3 by bolts 46 (FIG. 3). The hydraulic tappet holder 13 has hydraulic tappet holding sections 112 in which respective hydraulic tappets 15 of known construction are fitted for sliding motion. Upper ends of the air-intake valves 6 and the exhaust valves 7 are contacted with lower ends of the hydraulic tappets 15. Detailed construction of the hydraulic tappet holder 13 will be described later.

An air-intake valve drive apparatus 18 for transforming rotative motion of an air-intake cam shaft 16 into opening-closing motion of the air-intake valve 6 is provided between the air-intake valve 6 and the air-intake cam shaft 16. Between the exhaust valve 7 and an exhaust cam shaft 17 is provided an exhaust valve drive apparatus 19 for transforming rotative motion of the exhaust cam shaft 17 into opening-closing motion of the exhaust valve 7. The air-intake valve drive apparatus 18 has an air-intake rocker arm 22 fitted to a air-intake rocker arm shaft 20 so as to rock, and the exhaust valve drive apparatus 19 has an exhaust rocker arm 23 fitted to an exhaust rocker arm shaft 21 so as to rock. The air-intake rocker arm shaft 20 and the exhaust rocker arm shaft 21 penetrate a rocker arm shaft holder (lower cam holder) 24 and is fixed thereto.

As shown in FIG. 4, the rocker arm shaft holders 24 are arranged in a row so that each cylinder is positioned between neighboring rocker arm shaft holders, and attached to the cylinder head 3 by bolts 43 penetrating the rocker arm shaft holder 24 downward from above. The air-intake cam shaft 16 positioned above the air-intake rocker arm 22 is held between the rocker arm shaft holder 24 and an air-intake cam shaft holder (air-intake upper cam holder) 25 so as to rotate, the exhaust cam shaft 17 positioned above the exhaust rocker arm 22 is held between the rocker arm shaft holder 24 and an exhaust cam shaft holder 26 so as to rotate. The cam shaft holders 25, 26 are fixed to the rocker arm shaft holder 24 by means of bolts 44. On the one hand, the air-intake cam shaft 16 and the exhaust cam shaft 16 are connected with a crankshaft by means of a sprocket and a chain (not shown) so as to rotate once during the period the crankshaft rotates twice.

As shown in FIG. 1, the rocker arm shaft holder 24 has a low middle connecting portion 24*a* formed between respective portions holding the air-intake cam shaft 16 and the exhaust cam shaft 17. A cylinder head cover 27 is attached to the cylinder head 3 along outlines of the rocker arm shaft holder 24 and both the cam shaft holders 25, 26 with a slight gap. A breadthwise middle portion of the cylinder head cover 27 is shaped in a hollow corresponding to the middle connecting portion 24*a* of the rocker arm shaft holder 24.

The cylinder head cover 27 is pressed against the cylinder head 3 by a coil spring 30 through a rubber bush 29. The coil spring 30 is compressed to apply spring force to the cylinder head cover 27 by a bolt 28 which penetrates the middle bottom portion 27*a* of the cylinder head cover 27 and is screwed into a head of a bolt 45 provided at the middle connecting portion 24*a*.

Next, referring to FIG. 3, mechanisms for driving the air-intake valve 6 and the exhaust valve 7 will be described. The air-intake cam shaft 16 has journals (not shown) to be rotatively supported between the rocker arm shaft holder 24 and the cam shaft holder 25 disposed at regular intervals axially. The air-intake cam shaft 16 has also a first air-intake valve operation cam 51, an air-intake cam pause section 50, a third air-intake valve operation cam 53, an air-intake valve pause section 50, and a second air-intake valve operation cam 52 arranged between neighboring journals in this order from above in FIG. 3. Similarly the exhaust cam shaft 17 has a first exhaust valve operation cam 51', an exhaust valve pause section 50', a third exhaust valve operation cam 53', an exhaust valve pause section 50', and a second exhaust valve operation cam 52'.

The first air-intake valve operation cam 51 has a profile consisting of a circular base section surrounding the axis of the cam shaft as a center and a cam nose section projecting radially outward from the circular base section to make the air-intake valve 6 perform opening-closing motion substantially. The second air-intake valve operation cam 52 has the same profile as the first air-intake valve operation cam 51. The third air-intake valve operation cam 53 also has a profile consisting of a circular base section surrounding the axis of the cam shaft as a center and a cam nose section projecting radially outward from the circular base section. However, the cam nose section of the third air-intake valve operation cam is higher than those of the first and second air-intake valve operation cams 51, 52. The air-intake valve pause section 50 is formed in a circular surrounding the axis of the cam shaft with the same radius as that of the circular base section of the first air-intake valve operation cam 51. However, the air-intake valve pause section 50 may have a profile consisting of a circular base section surrounding he axis of the cam shaft as a center and a cam nose section which makes the air-intake valve in a pause state substantially but slightly open. The above is the same regarding the operation cams for the exhaust valve 7.

Figure 2:
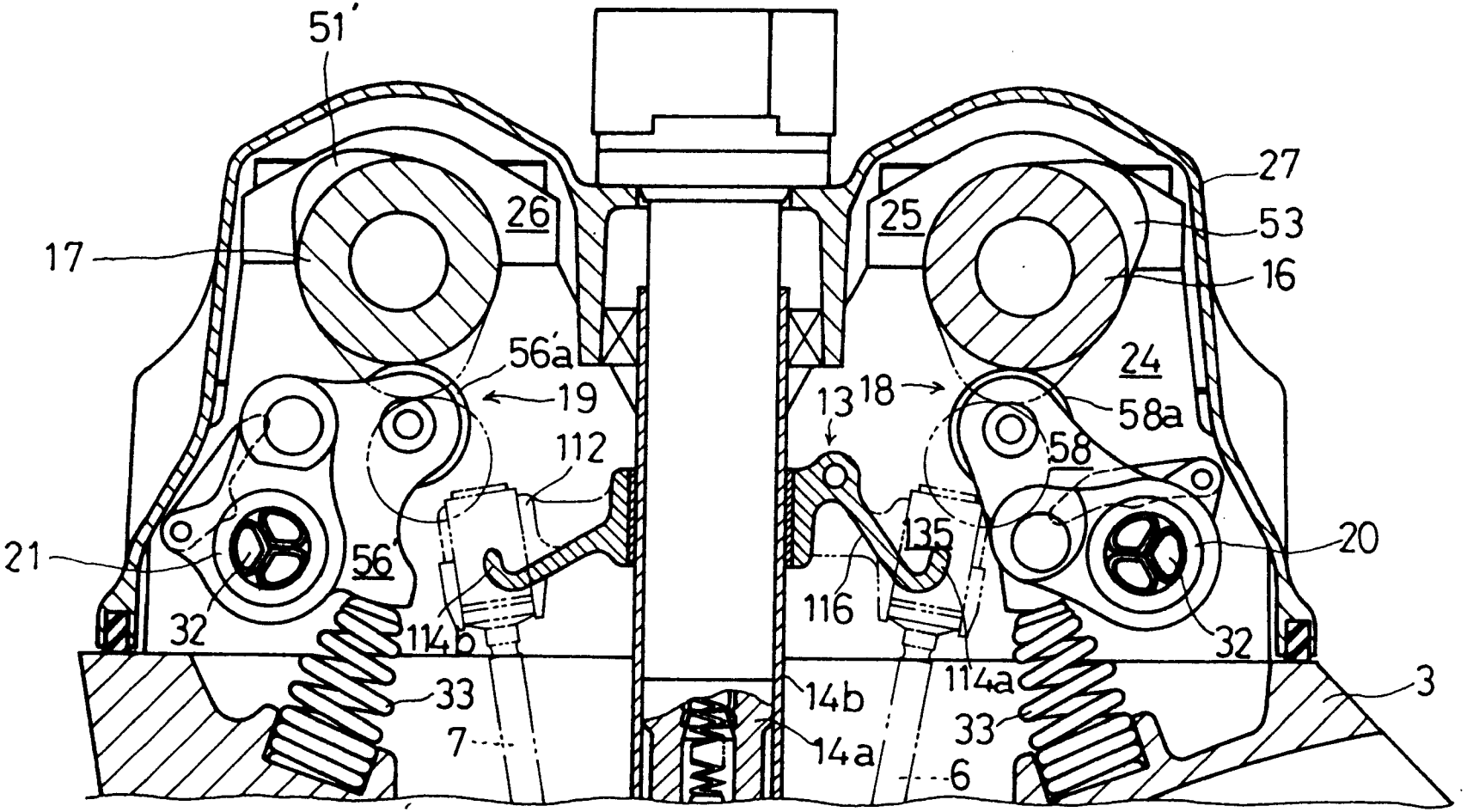
FIG. 2 is a section taken along the line II—II of FIG. 3.

As shown in FIGS. 1 and 2, the air-intake valve drive apparatus 18 comprises first and second air-intake valve drive rocker arms 54, 55 (FIG. 3), first, second and third air-intake valve free rocker arms 56, 57, 58 (FIG. 3), and the air-intake rocker arm shaft 20 which is fixed to the rocker arm shaft holder 24 at a position obliquely under the air-intake cam shaft 16 and supports the rocker arms 54, 55, 56, 57, 58 so as to rock.

The air-intake rocker arm shaft 20 has a hole of circular cross-section in which three pipe members 31 are inserted together. Each pipe members 31 has a fan-shaped cross-section which is not changed in the axial direction. The three pipe members 31 are put together in a cylindrical shape having a circular outer periphery, and inserted in the hole of the rocker arm shaft 20 in a state that the outer periphery is contacted with an inner wall of the hole.

The pipe members 31 constitute switching oil-pressure supply passages 32 for supplying oil-pressure to first, second and third connection switchover means 61, 62, 63 respectively. Namely, the passages 32 always communicate with oil-pressure chambers 72, 75, 84 (FIG. 6) of the first, second and third connection switchover means 61, 62, 63 through communication passages 73, 76, 85 (FIG. 6) formed within the first, second and third air-intake valve free rocker arms 56, 57, 58 respectively. The switching oil-pressure supply passages 32 are connected with an oil-pressure source through respective control valves (not shown). The control valves are controlled by a control means (not shown) in accordance with engine operation regions (a region with small amount of intake air, a region with middle amount of intake air and a region with large amount of intake air, for example) which is judged based on a cylinder pause direction signal or signals from means for detecting engine rotative speed, engine load, amount of intake air and the like.

As shown in FIG. 4, the rocker arm shaft holder 34 or the lower cam holder, in other words, has a hole 20*a* for supporting the air-intake rocker arm shaft 20. The hole 20*a* is formed just under one of the bolts 44 (the second fastening member) for fixing the air-intake cam shaft holder 25 or the air-intake upper cam holder, in other words, to the lower cam holder 24, which is positioned outside.

The lower cam holder 24 has a hole 21 a for supporting the exhaust rocker arm shaft 21. The hole 21*a* is formed just under one of the bolts 44 (the second fastening member) for fixing the exhaust cam shaft holder 26 or the exhaust upper cam holder, in other words, to the lower cam holder 24, which is positioned outside.

Therefore, the rocker arm shafts 20, 21 can be supported utilizing spaces under the bolts 44, an air-intake valve 6 and an exhaust valve 7 forming a narrow angle between them can be adopted, and the cylinder head 3 can be miniaturized.

The air-intake rocker arm shaft 20 and the exhaust rocker arm shaft 21 are disposed tangentially crossing the respective bolts (the first fastening member) 43. Therefore, the bolts 43 can be positioned inside to the utmost to contribute to miniaturization of the cylinder head 3 or the internal combustion engine 1.

Figure 10:
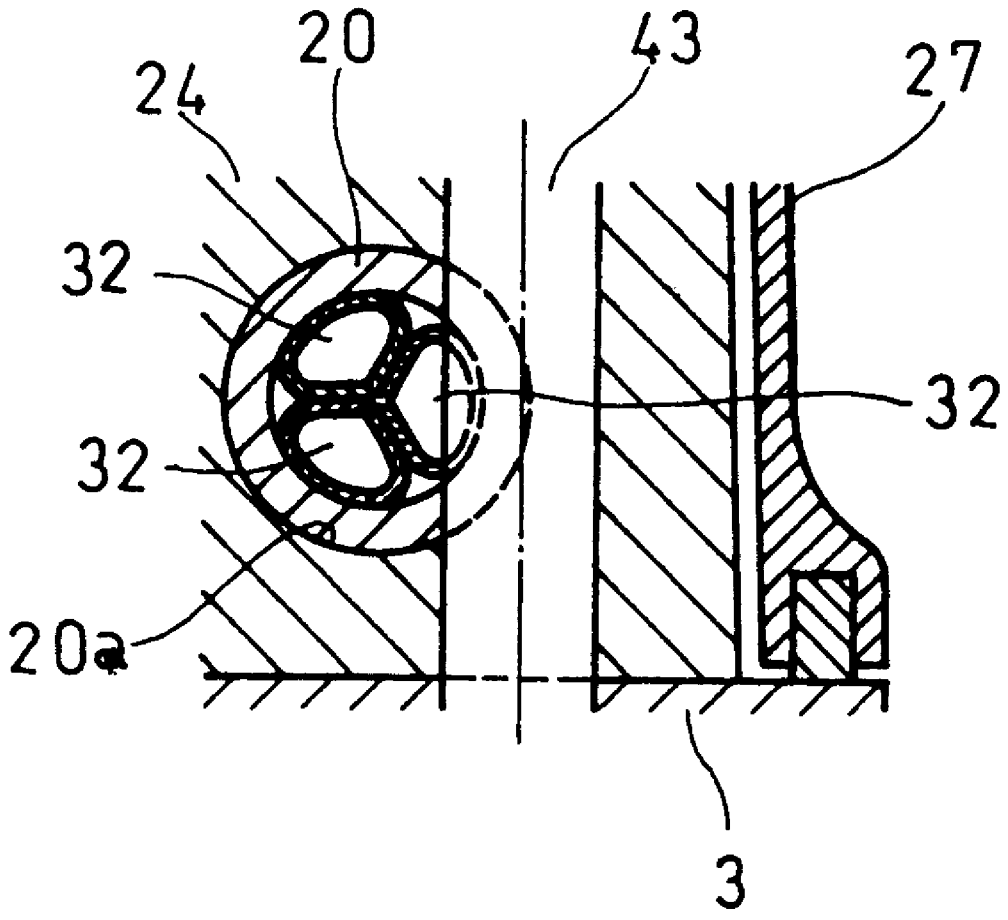
FIG. 10 is a sectional view showing the positional relation between a rocker arm shaft and a first fastening member in another embodiment.

As shown in FIG. 10, the air-intake rocker arm shaft 20 and the exhaust rocker arm shaft 21 may be arranged so as to be contacted with the bolts 43 more closely. According to such an arrangement, rotations of the rocker arm shafts 20, 21 can be prevented by the bolts 43.

In this case, the rocker arm shafts 20, 21 are disposed so that the bolt 43 penetrates only one of three switching oil-pressure supply passages 32 to prevent mutual communication of the switching oil-pressure supply passages.

As shown in FIG. 3, each of the first and second air-intake valve drive rocker arms 54, 55 has an end contacted with an upper end of the tappet 15 of the air-intake valve 6 and another end contacted with the air-intake valve pause section 50. The first air-intake valve free rocker arm 56 has a roller 56*a* coming into rolling contact with the first air-intake valve operation cam 51, the second air-intake valve free rocker arm 57 has a roller 57*a* coming into rolling contact with the second air-intake valve operation cam 52, and the third air-intake valve free rocker arm 58 has a roller 58*a* coming into rolling contact with the third air-intake valve operation cam 53. The first air-intake valve free rocker arm 56, the first air-intake valve drive rocker arm 54, the third air-intake valve free rocker arm 58, the second air-intake valve drive rocker arm 55 and the second air-intake valve free rocker arm 57 are arranged on the air-intake rocker arm shaft 20 at respective positions corresponding to the first air-intake valve operation cam 51, the air-intake valve pause section 50, the third air-intake valve operation cam 53, the air-intake valve pause section 50 and the second air-intake valve operation cam 52.

Springs 33 (FIG. 2) are provided between the cylinder head 3 and the respective first, second and third air-intake valve free rocker arms 56, 57, 58. The rocker arms 56, 57, 58 are forced by the springs 33 so as to always come into contact with the first, second and third air-intake valve operation cams 51, 52, 53.

The air-intake valve drive apparatus 18 has the first connection switchover means 61 for connecting and disconnecting the first air-intake valve drive rocker arm 54 with the first air-intake valve free rocker arm 56, the second connection switchover means 62 for connecting and disconnecting the second air-intake valve drive arm with the second air-intake valve free rocker arm 57, and the third connection switchover means 63 for connecting and disconnecting the first and second air-intake valve drive rocker arms 54, 55 with the third air-intake valve free rocker arm 58.

Figure 6:
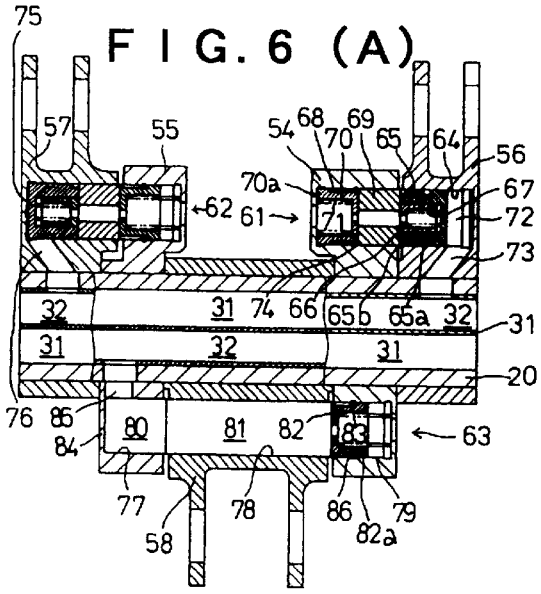
FIG. 6(A) to FIG. 6(D) are views showing modes of connection and disconnection of connection switchover means.
Figure 6:
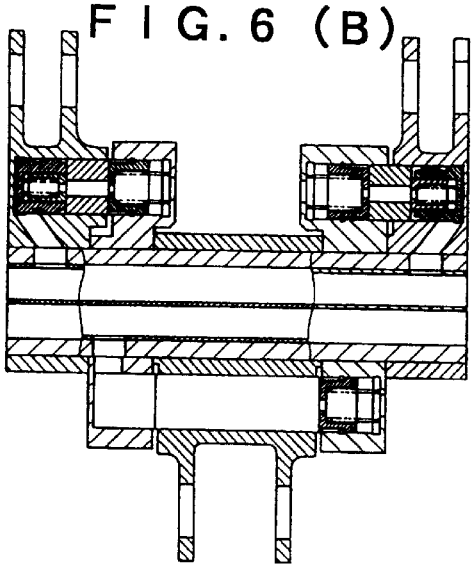
Figure 6:
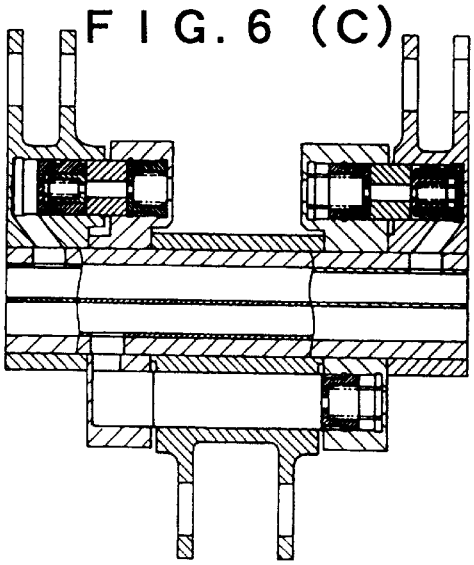
Figure 6:
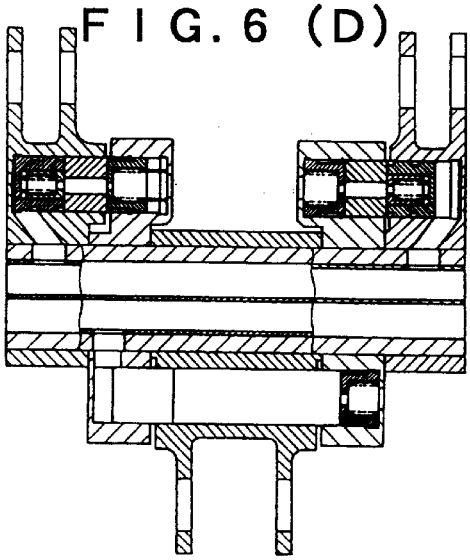
Figure 7:
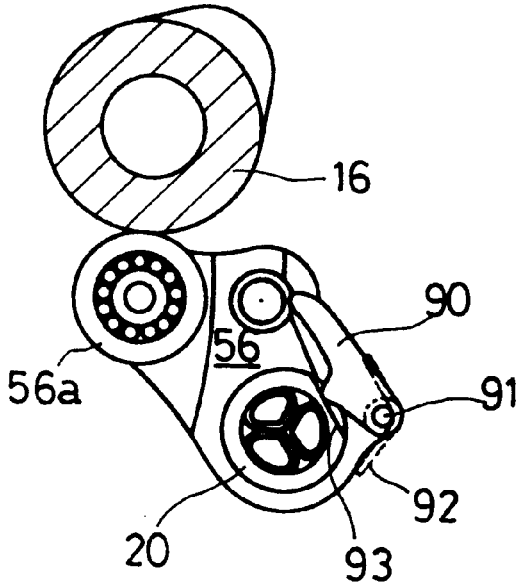
FIG. 7(A) and FIG. 7(B) are views for explaining movement of a timing plate of the connection switchover means.
Figure 7:
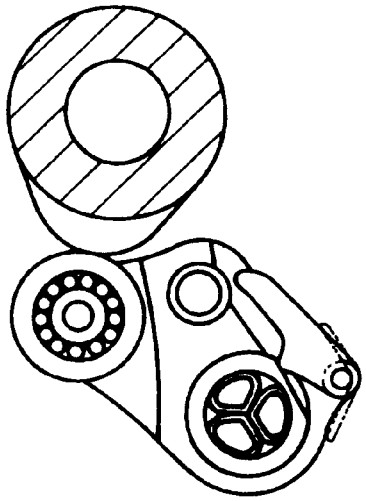

As shown in FIG. 6, the first connection switchover means 61 comprises a piston 65 fitted in a cylinder room 64 of the first air-intake valve free rocker arm 56 so as to slide, a pressing member 66 fitted in the piston 65 so as to slide, a pressing spring 67 compressed between the piston 65 and the pressing member 66, a switching pin 69 which is contacted with the pressing member 66 and adapted to be fitted in the cylinder room 68 of the first air-intake valve drive rocker arm 54 so as to slide, a regulating member 70 which is contacted with the switching pin 69 at a side opposite to the pressing member 66 and fitted in the cylinder room 68, and a return spring 71 compressed between the regulating member 70 and a bottom of the cylinder room 68. Set load of the return spring 71 is larger than that of the pressing spring 67.

The oil-pressure chamber 72 is formed between an end of the piston 65 and a bottom of the cylinder room 64. The oil-pressure chamber 72 always communicates with the first switching oil-pressure supply passage 32 in the air-intake rocker arm shaft 20 through the communication passage 73 formed in the first air-intake valve free rocker arm 56. The pressing member 66 disposed in the piston 65 is formed in a bottomed cylinder and has an open end facing a closed end of the piston 65. The pressing spring 67 is compressed between the closed end of the piston 65 and a bottom of the pressing member 66. The switching pin 69 can slide between a position in which it exists in both the cylinder rooms 64, 68 and extends over the first air-intake valve drive rocker arm 54 and the first air-intake valve free rocker arm 56, and another position in which it exists in the cylinder room 68 with its contact surface to the pressing member 66 positioned between the first air-intake valve drive rocker arm 54 and the first air-intake valve free rocker arm 56. The regulating member 70 is formed in a bottomed cylinder having the bottom on a side contacted with the switching pin 69. At an open end of the regulating member 70 are projected radially outward a flange 70*a* for coming into sliding contact with the cylinder room 68. In the cylinder room 68 is fitted a retaining ring 74 for regulating movement of the regulating member 70 toward the switching pin 69.

The first connection switchover means 61 is provided with a timing plate 90 (FIG. 7) for regulating timing of connection and disconnection of the first air-intake valve drive rocker arm 54 and the first air-intake valve free rocker arm 56. The timing plate 90 is pivotally supported by a pin 91 to the first air-intake valve free rocker arm 56 so that the timing plate 90 can rock between a position in which it engages with an engage groove 65*a* of the piston 65 or an engage groove 65*b* provided between the piston 65 and the switching pin 69 for regulating movement of the piston 65, and a position in which it comes out of the engage groove 65*a* or the engage groove 65*b* for allowing movement of the piston 65. The timing plate 90 is forced by a spring 92 so as to engage with the engage grooves 65*a*, 65*b*. An extent of rocking motion of the timing plate 90 is regulated by that the timing plate comes into contact with a stopper face 93 which is a flat bottom surface of a groove formed on an outer periphery of the air-intake rocker arm shaft 20.

In a state that oil-pressure in the oil-pressure chamber 72 is released, the switching pin 69 extends over the first air-intake valve free rocker arm 56 and the first air-intake valve drive rocker arm 54 to connect the rocker arms 54, 56 with each other due to spring force of the return spring 71. In this state, when the first air-intake valve free rocker arm 56 is contacted with the base circle section of the first air-intake valve operation cam 51, the timing plate 90 engages with the engage groove 65*b*. At this time, the timing plate 90 is contacted with the stopper face 93 and a slight gap is formed between the timing plate 90 and the bottom of the engage groove (FIG. 7(A)). When the first air-intake valve free rocker arm 56 is depressed by the cam nose section of the first air-intake valve operation cam 51, rocking motion of the timing plate 90 is limited as the timing plate 90 is contacted with the stopper face 93 and the plate 90 comes out of the engage groove 65*b* (FIG. 7(B)).

In a state that oil-pressure is applied into the oil-pressure chamber 72, when the timing plate 90 comes out of engage groove 65*b*, the piston 65 moves until it comes into contact with the switching pin 69 compressing the pressing spring 67. However, because the switching pin 69 extends over the first air-intake valve drive rocker arm 54 and the first air-intake valve free rocker arm 56, the switching pin 69 is subjected to shearing force, and due to the force, the piston 65 is prevented from moving until the switching pin 69 is completely pushed into the first air-intake valve drive rocker arm 54. When the first air-intake valve free rocker arm 56 begins to come into sliding contact with the base circle section of the first air-intake valve operation cam 51 and the above-mentioned shearing force becomes small, the piston 65 moves until the switching pin 69 is completely pushed into the first air-intake valve drive rocker arm 54 to disconnect the rocker arms 54, 56 with each other.

In a state that the first air-intake valve drive rocker arm 54 and the first air-intake valve free rocker arm 56 are disconnected, when the first air-intake valve free rocker arm 56 is in contact with the base circle section of the first air-intake valve operation cam 51, the timing plate 90 engages with the engage groove 65*a*. When the first air-intake valve free rocker arm 56 is depressed by the cam nose section of the first air-intake valve operation cam 51, the timing plate 90 comes into contact with the stopper face 93 by which rocking motion of the timing plate 90 is limited and it comes out of the engage groove 65*a*.

In the state that oil-pressure in the oil-pressure chamber 72 is released in order to connect the rocker arms 54, 56, when the first air-intake valve free rocker arm 56 is depressed by the cam nose section of the first air-intake valve operation cam 51 and the timing plate 90 comes out of the engage groove 65*a*, the piston 65 is moved by spring force of the pressing spring 67 to a position for minimizing the volume of the oil-pressure chamber 72. Then the first air-intake valve free rocker arm 56 begins to come into sliding contact with the base circle section of the first air-intake valve operation cam 51, and when axes of the cylinder rooms 64, 68 coincide with each other, the switching pin 69 is moved by spring force of the return spring 71 to a position in which the switching pin 69 extends over the rocker arms 54, 56 to connect the both.

The second connection switchover means 62 for connecting and disconnecting the second air-intake valve drive rocker arm 55 and the second air-intake valve free rocker arm 57 is basically identical with the above-mentioned first connection switchover means 61. However, in a state that oil-pressure in the oil-pressure chamber 75 is released, the switching pin is positioned within the second air-intake valve free rocker arm 57 and the rocker arms 55, 57 are disconnected with each other. When oil-pressure is applied to the oil-pressure chamber 75, the switching pin moves to a position in which the switching pin extends over the second air-intake valve drive rocker arm 55 and the second air-intake valve free rocker arm 57 to connect the rocker arms 55, 57. The oil-pressure chamber 75 formed between an end of the piston and the cylinder room always communicates with the second switching oil-pressure supply passage 32 through the communication passage 76 in the second air-intake free rocker arm 57.

The third connection switchover means 63 for connecting and disconnecting the first air-intake valve drive rocker arm 54, the second air-intake valve drive rocker arm 55 and the third air-intake valve free rocker arm 58 with each other comprises a switching pin 80 adapted to be fitted slidingly in a cylinder room 77 formed in the second air-intake valve drive rocker arm 55 and a cylinder room 78 formed in the third air-intake valve free rocker arm 58, a switching pin 81 adapted to be fitted slidingly in the cylinder room 78 and a cylinder room 79 formed in the first air-intake valve drive rocker arm 54 and contacted with the switching pin 80, a regulating member 82 contacted with an end of the switching pin 81 opposite to the switching pin 80 and fitted in the cylinder room 79 so as to slide, and a return spring 83 compressed between the regulating member 82 and a bottom of the cylinder room 79.

An oil-pressure chamber 84 is formed between an end of the switching pin 80 and the cylinder room 77. The oil-pressure chamber 84 always communicates with the third switching oil-pressure supply passage 32 through a communication passage 85 provided in the second air-intake valve drive rocker arm 55. Since the first, second and third switching oil-pressure supply passages 32 are independent of each other, the first, second and third connection switchover means 61, 62, 63 can perform switching operation independently of each other.

An end of the switching pin 81 comes into contact with the switching pin 80 and another end of the switching pin 81 comes into contact with a bottom part of the regulating member which is shaped in a bottomed cylinder. At an open end of the regulating member 82 is projected radially outward a flange 82*a* which comes into sliding contact with the cylinder room 72. A retaining spring 86 fixedly fitted to the cylinder room 79 comes into contact with the flange 82*a* to regulate movement of the regulating member 82 toward the switching pin 81.

In the third connection switchover means 63, when oil-pressure in the oil-pressure chamber 84 is released, the contact surface of the switching pins 80, 81 exists between the second air-intake valve driver rocker arm 55 and the third air-intake valve free rocker arm 58, and the contact surface of the switching pin 81 and the regulating member 82 exists between the third air-intake valve free rocker arm 58 and the first air-intake valve driver rocker arm 54, to bring the rocker arms 54, 55, 58 into disconnected states. When oil-pressure is applied to the oil-pressure chamber 84, the switching pin 80 moves until an end of the pin 80 opposite to the chamber 84 is positioned in the cylinder room 78, and the switching pin 81 moves until an end of the pin 81 opposite to the pin 80 is positioned in the cylinder room 79. Thus the rocker arms 54 55, 58 are connected with each other.

Figure 8:
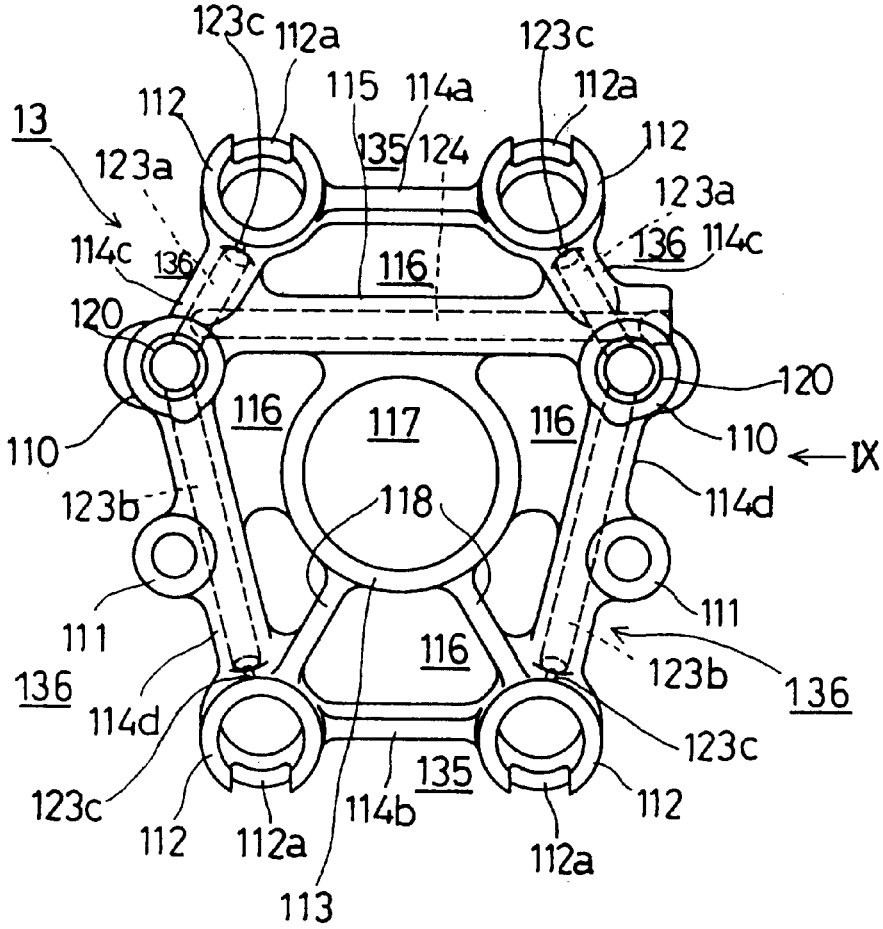
FIG. 8 is a plan view of the hydraulic tappet holder.
Figure 9:
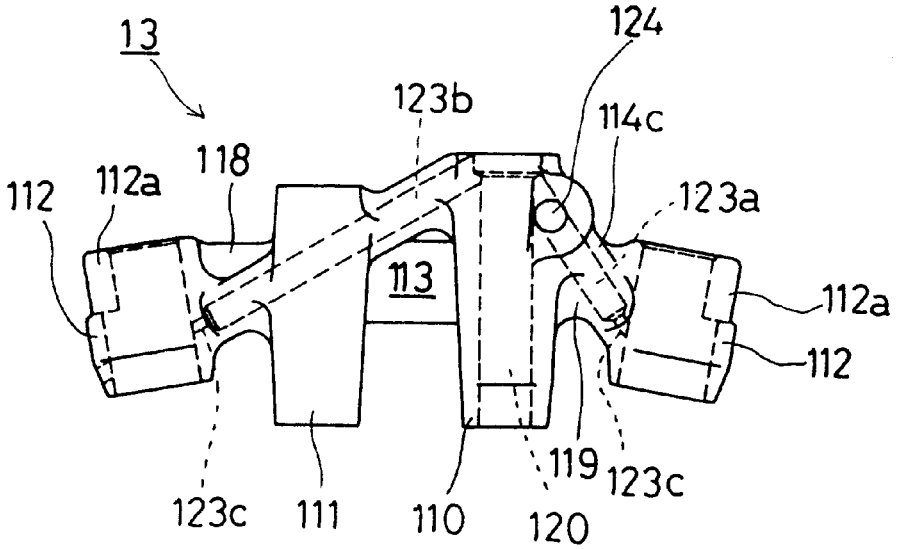
FIG. 9 is a view of the hydraulic tappet holder viewed in the direction of the arrow IX of FIG. 8.

Next, the hydraulic tappet holder 13 for holding the hydraulic tappet 15 will be described. As shown in FIG. 8, the hydraulic tappet holder 13 comprises a pair of attachment legs 110, a pair of attachment legs 111, four hydraulic tappet holding sections 112 for holding the respective hydraulic tappets 15 so as to slide, a cylindrical ignition plug holding section 113, frame members 114*a*, 114*b*, 114*c* and 114*d* forming together a hexagonal plan and integrally combining the attachment legs 110, 111 and the hydraulic tappet holding sections 112, a connecting part 115 positioned on a side of the ignition plug holding section 113 toward the air-intake valve 6 and connecting the attachment legs 110 to each other, and a thin part 116 formed among the attachment legs 110, 111, the hydraulic tappet holding sections 112, and ignition plug holding section 113, the frame members 114*a*, 114*b*, 114*c*, 14d ad the connecting part 115. The frame members 114*a*, 114*b* connecting the hydraulic tappet holding sections 112 for the air-intake valves 6 and the hydraulic tappet holding sections 112 for the exhaust valves 7, respectively, have the same thickness as the thin part 116 and are curved to join with the thin part 116 (FIG. 2). The frame members 114*c*, 114*d* connecting the attachment legs 110 to the respective hydraulic tappet holding sections 112 are inclined downward toward the hydraulic tappet holding sections 112. The ignition plug holding section 113 has an insertion hole 117 in which a pipe 14*b* receiving an ignition plug 14*a* is inserted, the ignition plug 14*a* is held by the cylinder head 3 through the pipe 14*b*.

On a side of each of the hydraulic tappet holding sections 112 for the air-intake valve 6 facing toward the air-intake rocker arm shaft 20 is formed a cut dent 112*a* which receives a part of the first air-intake valve drive rocker arm 54 or the second air-intake valve rocker arm 55 when the air-intake valve 6 is opened. Similarly, on a side of each of the hydraulic tappet holding sections 112 for the exhaust valve 7 facing toward the exhaust rocker arm shaft 21 is formed a cut dent 112*a* which receives a part of the first exhaust valve drive rocker arm 54' or the second exhaust valve drive rocker arm 55'.

A reinforcement rib 118 formed on an upper surface of the thin part 116 extends radially from the ignition plug holding section 113 to join with the hydraulic tappet holding section 112 for the exhaust valve 7. The rib 118 prevents the hydraulic tappet holding section 112 from having reduced strength due to formation of the cut dent 112*a*. On the one hand, between the ignition plug holding section 113 and the hydraulic tappet holding section 112 for the air-intake valve 6 is formed a reinforcement rib 119 (FIG. 9), which is formed on a lower surface of the thin part 116 and extends radially from the ignition plug holding section 113 to join with the hydraulic tappet holding section 112 the air-intake valve 6 similarly to the rib 118.

Figure 5:
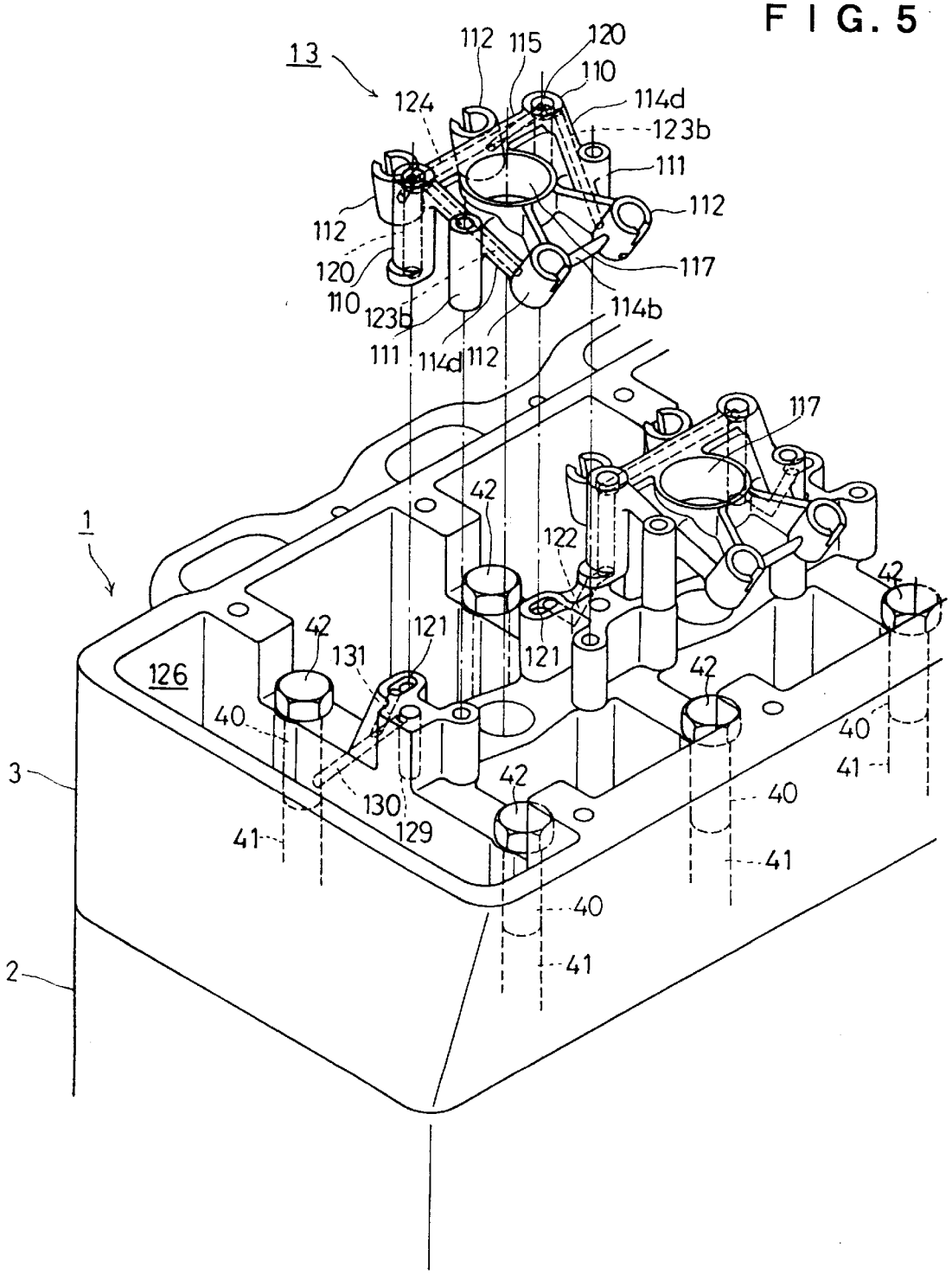
FIG. 5 is a perspective view showing an arrangement of hydraulic tappet holders.

In the cylinder head 3 is formed a bolt hole 121 along a lower extension line of the bolt hole 120 of the hydraulic tappet holder 13. The bolt 46 (FIG. 3) screwed in the cylinder head 3 passing through the bolt hole 120 for fixing the hydraulic tappet holder 13 to the cylinder head 3 passes through the hole 121. As shown in FIG. 5, a pair of right and left openings of the bolt holes 121 disposed on respective sides of the rocker arm shaft holder 24 communicate with each other through a V-shaped oil communication passage 122 formed in the cylinder head 3.

The diameter of the bolt hole 120 is larger than that of the bolt 46 so that oil can pass through the attachment leg 110. Oil communication passages 123*a*, 123*b* are formed in the frame members extending obliquely downward from the bolt hole 120 toward the hydraulic tappet holding section 112, and an oil communication passage 124 connecting the oil communication passages 123*a* of the air-intake valve side with each other is formed in the connecting part 115. The hydraulic tappets 15 are supplied with oil through openings 123*c* provided on respective ends of the oil communication passages 123*a*, 123*b*.

An oil supply system to the hydraulic tappet holder 13 will be described. Oil delivered from an oil pump connected to a crankshaft of the engine 1 is led through an oil filter to a main gallery 125 (FIG. 4) which is formed in the cylinder block 2 in parallel with the crankshaft. Between an end of the main gallery 125 near a cam chain chamber 126 and one of the bolt holes 41 in the cylinder head 3 near the cam chain chamber 126 is formed an oil passage hole 127 to supply the oil to the bolt hole 41.

As shown in FIGS. 4, 5, a bolt hole 128 for the bolt 45 is formed in the middle connecting portion 24*a* of the rocker arm shaft holder 24 neighboring the cam chain chamber 126, and a bolt hole 129 is formed in the cylinder head 3 along a lower extension line of the bolt hole 128. An oil communication hole 130 is extended from an opening of the bolt hole 129 to the bolt hole 40 in which the bolt 42 for fixing the cylinder head 3 to the cylinder block 2 is inserted. Further, an oil communication passage 131 is extended from an opening of the bolt hole 121 neighboring the cam chain chamber 126 to the oil communication hole 130.

Oil communication holes 132 extend from the bolt hole 128 of the rocker arm shaft holder 24 obliquely upward toward bearing sections of the air-intake cam shaft 16 and the exhaust cam shaft 17. Also in the air-intake cam shaft 16 and the exhaust cam shaft 17 themselves, oil communication holes 133 communicating with the oil communication holes 132 are formed penetrating circumferential walls of the cam shafts 16, 17. Similar oil communication holes 132, 133 are formed also at other bearing sections of the air-intake cam shaft 16 and the exhaust cam shaft 17.

Next, positional relations of the first and second air-intake valve drive rocker arms 54, 55 and the first, second and third air-intake valve free rocker arms 56, 57, 58 to the hydraulic tappet holder 13 will be described.

As shown in FIG. 2, at each end of the frame member 114*a* between the hydraulic tappet holding sections 112 for the air-intake valves 6, a side of the frame member 114*a* facing toward the air-intake rocker arm shaft 20 is tangent to a plane including the axis of the cylindrical hydraulic tappet holding section 112, and an upper end of the frame member 114*a* is positioned in the neighborhood of an axial middle of the cylindrical hydraulic tappet holding section 112. Therefore, as shown in FIG. 8, a recess 135 facing toward the air-intake rocker arm shaft 20 is formed in the hydraulic tappet holder 13 by the hydraulic tappet holding sections 112 for the air-intake valves 6 and the frame member 114*a*. The hydraulic tappet holder 113, the air-intake rocker arm shaft 20 and the air-intake cam shaft 116 are arranged so that the roller 58*a* of the third air-intake valve free rocker arm 58 pivotally supported on the air-intake rocker arm shaft 20 is received in the recess 135. That the roller 58*a* is received in the recess 135 means that the hydraulic tappet holding section 112 and the roller 58*a* are overlapped when viewed in an axial direction of the crankshaft (direction perpendicular to the surface of FIGS. 1 or 2).

The roller 58*a* of the third air-intake valve free rocker arm 58 may be received in the recess 135 when the roller 58*a* is in sliding contact with the base circle section of the third air-intake valve operation cam 53, or the roller 58*a* may be received in the recess 135 when the third air-intake valve free rocker arm 58 is in sliding contact with the cam nose section of the third air-intake valve operation cam 53 and has rotated by a predetermined angle. Anyway, the roller 58*a* should be received in the recess 135 in at least a part of rocking range of the third air-intake valve free rocking arm 58. Therefore, the roller 58*a* may be positioned near the frame member 114*a* with a slight gap when lift of the air-intake valve 6 is maximum.

The attachment legs 110 of the hydraulic tappet holder 13 are arranged on a line parallel with the crankshaft and a distance between the attachment legs 110 is larger than that between the hydraulic tappet holding sections 112 for the air-intake valves 6. An outside face of the frame member 114*c* connecting the attachment leg 110 with the hydraulic tappet holding section 112 for the air-intake valve 6 is positioned toward a center of the hydraulic tappet holder 13 with regard to a plane tangential to both cylindrical surfaces of the attachment leg 110 and the hydraulic tappet holding section 112. Therefore, the hydraulic tappet holder 13 has a pair of recesses 136 formed by the attachment legs 110, the hydraulic tappet holding sections 112 for the air-intake valves 6 and the outside faces of the frame members 114*c*. The hydraulic tappet holder 13, the air-intake rocker arm shaft 20 and the air-intake cam shaft 16 (see FIG. 2) are arranged so that the rollers 56*a*, 57*a* of the first and second air-intake valve free rocker arms 56, 57 are received in the recesses 136 respectively.

The meaning of receiving the rollers 56*a* 57*a* in the recesses 136 is the same as in the case regarding the recess 135 and the third air-intake valve free rocker arm 58.

Regarding the exhaust valve 7, arrangement of the hydraulic tappet holder 13, the exhaust rocker arm shaft 21 and the exhaust cam shaft 17 is basically the same as the foregoing. That is, the roller 58'*a* of the third exhaust valve free rocker arm 58' is received in the recess 135 formed between the hydraulic tappet holding sections 112 for the exhaust valve 7, and the rollers 56'*a*, 57'*a* of the first and second exhaust valve free rocker arms 56', 57' are received in the recesses 136 formed between the respective attachment legs 110 and the respective hydraulic tappet holding sections 112 for the exhaust valve 7.

The above-mentioned embodiment of the present invention acts as follows.

During operation of the internal combustion engine 1, if a cylinder pause instruction signal is made, the aforementioned control valve controls oil-pressure of the switching oil-pressure supply passage 32 on the basis of the signal so that all of the first, second and third connection switchover means 61, 62, 63 of the air-intake valve drive apparatus 18 are made in a disconnected state and similarly, all of the three connection switchover means of the exhaust valve drive apparatus 19 are made in disconnected states. Therefore, the first and second air-intake valve drive rocker arms 54, 55 and the first and second exhaust valve rocker arms 54', 55' come into contact with the pause sections 50, 50' of the air-intake cam shaft 16 and the exhaust cam shaft 17 to bring the air-intake valves 6 and the exhaust valves 7 in substantially closed pause states and the engine is brought into a cylinder pause state (FIG. 6(A)).

When the engine 1 is operated in a operation region with a small amount of intake air, such as a low rotative speed region or a low load region, in the air-intake valve drive apparatus 18, the first connection switchover means 61 is connected and the second and third connection switchover means 62, 63 are disconnected, on the one hand, and in the exhaust valve drive apparatus 19, the first connection switchover means is connected and the second and third connection switchover means are disconnected. Thus, the first air-intake valve drive rocker arm 54 is connected with the first air-intake valve free rocker arm 56, and the first exhaust valve drive rocker 54' is connected with the first exhaust valve free rocker arm 56', therefore, the first air-intake valve driver rocker arm 54 and the first exhaust valve drive rocker arm 54' are driven by the first air-intake operation cam 51 of the exhaust cam shaft 17, respectively, and one of the air-intake valves 6 and one of the exhaust valves 6 of a cylinder are made to perform opening-closing motion in accordance with the profiles of the respective operation cams 51, 51' with smaller lifts than those of the third air-intake valve operation cam 53 and the third exhaust valve operation cam 53, while the second air-intake valve driver rocker arm 55 and the second exhaust valve drive rocker arm 55' are in contact with the pause sections 50, 50' of the air-intake cam shaft 16 and the exhaust cam shaft 17 to bring another air-intake valve 6 and another exhaust valve 7 of the cylinder in substantially closed pause states. Since only one air-intake valve 6 performs opening-closing motion to produce vortex or swirl in the combustion chamber, the nature of combustion is improved, circulation of a large amount of exhaust gas or lean combustion in engine low-speed or low-load operation region is possible, and emission and fuel consumption can be improved (FIG. 6(B)).

When the engine 1 is operated in an operation region with an intermediate amount of intake air, such as a middle rotative speed region or a middle load region, in the air-intake valve drive apparatus 18, the first and second connection switchover means 61, 62 are connected and the third connection switchover means 63 is disconnected, on the one hand. And in the exhaust valve drive apparatus 19, the first and second connection switchover means are connected and the third connection switchover means is disconnected to connect the first and second air-intake valve drive rocker arms 54, 55 with the first and second air-intake valve free rocker arms 56, 57, respectively, and the first and second exhaust valve free rocker arms 56', 57', respectively. Therefore, the first and second air-intake valve operation cams 51, 52 of the air-intake cam shaft 16, and the first and second exhaust valve drive rocker arms 54', 55' are driven by the first and second exhaust valve drive rocker arms 54, 55 are driven by the first and second air-intake valve operation cams 51', 52' of the exhaust cam shaft 17. Accordingly, one of the air-intake valves 6 and one of the exhaust vales 7 in one cylinder are made to perform opening-closing motions in accordance with the profiles of the first air-intake valve operation cam 51 and the first exhaust valve operation cam 51' with smaller lifts than those of the third air-intake valve operation cam 53 and the third exhaust valve operation cam 53', while another air-intake valve 6 and another exhaust valve 7 are made to perform opening-closing motion in accordance with profiles of the second air-intake operation cam 52 and the second exhaust operation cam 52' with lifts smaller than those of the third air-intake valve operation cam 53 and the third exhaust valve operation cam 53'. Since both the air-intake valves 6 are made to perform opening-closing motion in an engine operation region with a middle amount of intake air, engine output in an engine operation region between a low speed or low load region and a high speed or high load region can be improved (FIG. 6(C)).

When the engine 1 is operated in an operation region with a large amount of intake air, such as high rotative speed or high load region, in the air-intake valve drive apparatus 18, the third connection switchover means 63 is connected, on the one hand, in the exhaust valve drive apparatus 19, the third connection switchover means is connected to connect the first and second air-intake valve drive rocker arms 54, 55 with the third air-intake valve free rocker arm 58 and the first and second exhaust valve drive rocker arms 54', 55' with the third exhaust valve free rocker arm 58'. Therefore, the first and second air-intake valve drive rocker arms 54, 55 are driven by he air-intake valve operation cam 53 of the air-intake cam shaft 16, and the first and second exhaust valve drive rocker arms 54', 55' are driven by the exhaust valve operation cam 53' of the exhaust cam shaft 17. Accordingly, both the air-intake valves 6 and both the exhaust valves 7 are made to perform opening-closing motion in accordance with the profiles of the third air-intake valve operation cam 53 and the third exhaust vale operation cam 53' with a large lift, so that a high engine output required in an operation region with a large amount of intake air can be obtained. At that time, the first and second connection switchover means 61, 62, . . . may be connected or may be disconnected. In the latter case, since the first and second free rocker arms 56, 57, 56', 57' are cut off from the drive system of the air-intake valves 6 and the exhaust valves 7, weight of the rocker arms driving the valves 6, 7 is small so that the critical rotative speed can be raised (FIG. 6(D)).

Each of the switching oil-pressure supply passages 32 is formed by the pipe member 31 and it is necessary only to insert these pipe members 31 in the hole of circular section formed in the respective rocker arm shafts 20, 21, so that three switching oil-pressure supply passages are formed easily and cost can be reduced. Each of the pipe members 31 has a fan-shaped cross-section unchanged axially, and three pipe members 31 are combined together in a circular cylindrical shape and inserted in the hole of the respective rocker arm shafts 20, 21 in a state that the periphery of the combined pipe members 31 is in contact with the peripheral wall of the hole in the respective rocker arm shafts 20, 21. Therefore, the space in the hole can be utilized efficiently, and three switching oil-pressure supply passages each having a necessary passage area can be disposed in the shaft compactly. Thus, the valve mechanism can be miniaturized.

Even when the third air-intake valve free rocker arm 58 and the third exhaust valve free rocker arm 58' approach the hydraulic tappet holders 13 most closely, the roller 58*a*, 58'*a* of the free rocker arms 58, 58' can be received in the recess 135 formed between the hydraulic tappet holding sections 112, and to the extent, horizontal and vertical distances between the air-intake and exhaust rocker arm shafts 20,21 and the respective hydraulic tappet holding sections 112 can be made small. Therefore, the valve mechanism can be miniaturized and freedom of layout of the valve mechanism component members in the valve mechanism chamber increases.

Even when the first and second air-intake valve free rocker arms 56, 57 and the first and second exhaust valve free rocker arms 56', 57' approach the hydraulic tappet holder 13 to the utmost, the rollers 56a, 57*a*, 56'*a*, 57'*a* of the free rocker arms 56, 57, 56', 57' can be received in the recesses 136 formed between the attachment legs 110, 111 and the hydraulic tappet holding sections 112, and to the extent, distances between both the air-intake rocker arms 22 and between both the exhaust rocker arms 23 in an axial direction of the rocker arm shaft at every cylinder can be made small. Therefore, the air-intake rocker arms 22 and the exhaust rocker arms 23 can be made compact and the valve mechanism can be miniaturized.

As mentioned above, the cut recesses 112*a* are formed at a side of each hydraulic tappet holding section 112 of the hydraulic tappet holder 13 facing toward the rocker arm shaft 20 or 21 for receiving a part of the first or second air-intake valve drive rocker arm 54 (55) or the first or second exhaust valve drive rocker arm 54(55') therefore, vertical distances between the hydraulic tappet holding sections 112 and the rocker arm shafts 20, 21 can be made small to miniaturize the valve mechanism. Since the reinforcement ribs 118, 119 are formed between the cylindrical ignition plug holding section 112 and the respective hydraulic tappet holding sections 112, lowering of strength of the hydraulic tappet holding section 112 due to formation of the cut recess 112*a* can be prevented.

In the aforementioned embodiment, the profile of the second air-intake valve operation cam 52 is the same as that of the first air-intake valve operation cam 51. However, both of the profiles may be made different to set opening times, closing times or opening lifts of the first and second air-intake valves differently from each other. The pipe members 31 constituting the switching oil-pressure supply passages 32 have the same cross-sectional areas usually, but, if necessary, the cross-sectional areas may be made different from each other.

What is claimed is:

1. A valve mechanism of an internal combustion engine having a cylinder with a pair of air-intake valves, comprising;

a cam shaft having a pair of pause sections for holding the air-intake valves substantially in closing pause states, a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first driver rocker arm and the second driver rocker arm with the third free rocker arm; and at least one of the drive rocker arms being pivotally supported on a rocker arm shaft and operatively connected to the air-intake valve through a hydraulic tappet which is held by a hydraulic tappet holder fixed to a cylinder head of the engine, and the hydraulic tappet holder being formed with a recess positioned within a rocking range of the drive rocker arm and capable of receiving the drive rocker arm partially.

2. A valve mechanism of an internal combustion engine having a cylinder with a pair of air-intake valves, comprising;

a cam shaft having a pair of pause sections for holding the air-intake valves substantially in closing pause states, a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first driver rocker arm and the second driver rocker arm with the third free rocker arm; and the first and second drive rocker arms being pivotally supported on a rocker arm shaft and operatively connected to the air-intake valves through respective hydraulic tappets which are held by respective hydraulic tappet holding sections of a hydraulic tappet holder fixed to a cylinder head of the engine, and the hydraulic tappet holding sections being formed with recesses positioned within rocking ranges of the first and second drive rocker arms and capable of receiving the drive rocker arms partially.

3. A valve mechanism of an internal combustion engine having a cylinder with a pair of air-intake valves, comprising:

a cam shaft having a pair of pause sections for holding the air-intake valves substantially in closing pause states a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first drive rocker arm and the second drive rocker arm with the third free rocker arm wherein, in an engine operation region with the cylinder pausing, the first, second and third connection switchover means are in disconnecting states; in an engine operation region with a small amount of intake air, the first connection switchover means is in a connecting state and the second and third connection switchover means are in disconnecting states; in an engine operation region with a middle amount of intake air, the first and second connection switchover means are in a connecting state and the third connection switchover means is in a disconnecting state; and in an engine operation region with a large amount of intake air, the third connection switchover means is in a connecting state; and pipe members of fan-shaped cross section being provided in an axial hole of a rocker arm shaft pivotally supporting the rocker arms, the pipe members communicating with the first, second and third connection switchover means to constitute first, second and third switching oil-pressure supply passages, respectively.

4. A valve mechanism of an internal combustion engine as claimed in claim 3, wherein the air-intake valves are operatively connected to the first and second drive rocker arms through hydraulic tappets respectively, and a hydraulic tappet holder for holding the hydraulic tappets has respective hydraulic tappet holding sections between which a recess is formed for receiving a roller of the third free rocker arm contacted with the third operation cam.

5. A valve mechanism of an internal combustion engine having a cylinder with a pair of air-intake valves, comprising:

a cam shaft having a pair of pause sections for holding the air-intake valves substantially in closing pause states, a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first drive rocker arm and the second drive rocker arm with the third free rocker arm; and pipe members of fan-shaped cross section being provided in an axial hole of a rocker arm shaft pivotally supporting the rocker arms, the pipe members communicating with the first, second and third connection switchover means to constitute first, second and third switching oil-pressure supply passages respectively.

6. A valve mechanism of an internal combustion engine as claimed in claim 5, wherein the air-intake valves are operatively connected to the first and second drive rocker arms through hydraulic tappets respectively, and a hydraulic tappet holder for holding the hydraulic tappets has respective hydraulic tappet holding sections between which a recess is formed for receiving a roller of the third free rocker arm contacted with the third operation cam.

7. A valve mechanism of an internal combustion engine having a cylinder with a pair of air-intake valves, comprising;

a cam shaft having a pair of pause sections for holding the air-intake valves substantially in closing pause states, a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first driver rocker arm and the second driver rocker arm with the third free rocker arm; and air-intake valves operatively connected to the first and second drive rocker arms through hydraulic tappets respectively, and a hydraulic tappet holder for holding the hydraulic tappets having respective hydraulic tappet holding sections between which a recess is formed for receiving a roller of the third free rocker arm contacted with the third operation cam.

8. A valve mechanism of an internal combustion engine having a cylinder with a pair of air-intake valves, comprising;

a cam shaft having a pair of pause sections for holding the air-intake valves substantially in closing pause states, a first operation cam with a profile capable of causing the air-intake valve to perform opening-closing motion, a second operation cam with a profile capable of causing the air-intake valve to perform opening-closing motion, and a third operation cam with a profile capable of causing the air-intake valve to perform opening-closing motion with a larger lift compared to the first and second operation cams;

a first drive rocker arm operatively connected to one of the air-intake valves and contacted with one of the pause sections of the cam shaft;

a second drive rocker arm operatively connected to another air-intake valve and contacted with another pause section of the cam shaft;

a first free rocker arm contacted with the first operation cam;

a second free rocker arm contacted with the second operation cam;

a third free rocker arm contacted with the third operation cam;

a first connection switchover means for connecting and disconnecting the first drive rocker arm with the first free rocker arm;

a second connection switchover means for connecting and disconnecting the second drive rocker arm with the second free rocker arm;

a third connection switchover means for connecting and disconnecting the first driver rocker arm and the second driver rocker arm with the third free rocker arm; and a valve mechanism supporting structure comprising an air-intake cam shaft bearing section for supporting an air-intake cam shaft, an exhaust cam shaft bearing section for supporting an exhaust cam shaft, a lower cam holder common to the both cam shaft bearing sections, an air-intake upper cam holder cooperating with the lower cam holder to form the air-intake cam shaft bearing section, and an exhaust upper cam holder cooperating with the lower cam holder to form the air-intake cam shaft bearing section, and an exhaust upper cam holder cooperating with the lower cam holder to form the exhaust cam shaft bearing section, both ends of the lower cam holder being fixed to a cylinder head of the engine by first fastening members, and both ends of the air-intake upper cam holder and both ends of the exhaust upper cam holder being fixed to the lower cam holder at positions inside of the first fastening members by second fastening members having diameters smaller than that of the first fastening member.

9. A valve mechanism of an internal combustion engine as claimed in claim 8, wherein the lower cam holder supports an air-intake rocker arm shaft and an exhaust rocker arm shaft so as not to rotate, the air-intake rocker arm shaft is disposed under one of the second fastening members for the air-intake upper cam holder positioned outside, and the exhaust rocker arm shaft is disposed under one of the second fastening members for the exhaust upper cam holder positioned outside.

10. A valve mechanism of an internal combustion engine as claimed in claim 9, wherein the each rocker arm shaft is disposed crossing the corresponding first fastening member.

11. A valve mechanism of an internal combustion engine as claimed in claim 8, wherein the each rocker arm shaft is disposed crossing the corresponding first fastening member.

12. A valve mechanism of an internal combustion engine as claimed in claim 11, wherein pipe members of fan-shaped cross section are provided in an axial hole of a rocker arm shaft pivotally supporting the rocker arms, the pipe members communicate with the first, second and third connection switchover means to constitute first, second and third switching oil-pressure supply passages respectively, and the first fastening member penetrates only one of the switching oil-pressure supply passages.

* * * * *